US007387408B2

(12) United States Patent
Holten et al.

(10) Patent No.: US 7,387,408 B2
(45) Date of Patent: Jun. 17, 2008

(54) LUMINAIRE FEATURING LIGHT-TRANSMITTING COUNTER REFLECTOR COVER

(75) Inventors: Petrus Adrianus Josephus Holten, Winterswijk (NL); Paulus Gerardus Henricus Kosters, Winterswijk (NL); Corinne Lac, Beynost (FR)

(73) Assignee: Koninklijke Philips Electronics, N.V., Eindhoven (NL)

( * ) Notice: Subject to any disclaimer, the term of this patent is extended or adjusted under 35 U.S.C. 154(b) by 471 days.

(21) Appl. No.: 10/511,214

(22) PCT Filed: Apr. 14, 2003

(86) PCT No.: PCT/IB03/01511

§ 371 (c)(1),
(2), (4) Date: Oct. 13, 2004

(87) PCT Pub. No.: WO03/087656

PCT Pub. Date: Oct. 23, 2003

(65) Prior Publication Data

US 2005/0254245 A1 Nov. 17, 2005

(30) Foreign Application Priority Data

Apr. 18, 2002 (EP) ..... 02290990

(51) Int. Cl.
*F21V 7/00* (2006.01)

(52) U.S. Cl. ..... 362/299; 362/298; 362/300

(58) Field of Classification Search ..... 362/298, 362/299, 300

See application file for complete search history.

(56) References Cited

U.S. PATENT DOCUMENTS

| | | | | |
|---|---|---|---|---|
| 4,755,916 | A * | 7/1988 | Collins | 362/298 |
| 5,065,287 | A * | 11/1991 | Staiger et al. | 362/297 |
| 6,334,700 | B2 * | 1/2002 | Ramer et al. | 362/298 |

FOREIGN PATENT DOCUMENTS

| | | |
|---|---|---|
| DE | 19609262 | 9/1997 |
| EP | 535416 | 9/1992 |
| EP | 0846915 | 6/1998 |

* cited by examiner

*Primary Examiner*—Ali Alavi
*Assistant Examiner*—William J Carter

(57) ABSTRACT

A luminaire (1) is disclosed, comprising a main reflector (3) with a light emission window (5), and comprising a counter reflector (7) positioned opposite to the main reflector. Means (9) for accommodating at least one electric lamp (11) are provided in the luminaire in between the main reflector and the counter reflector. The counter reflector is provided with a light-transmitting cover (13), acting as an optical waveguide and positioned at a side (15) of the counter reflector facing away from the means (9). The cover is provided with diffusor bodies (21) which scatter the light coupled into the cover and transmitted through the bulk of the cover. Thus a desired distribution and appearance of the optical brightness of the cover is obtained.

7 Claims, 3 Drawing Sheets

LUMINAIRE FEATURING LIGHT-TRANSMITTING COUNTER REFLECTOR COVER

The invention relates to a luminaire comprising:

a main reflector with a light emission window;

a counter reflector positioned opposite to the main reflector;

means for accommodating at least one electric lamp positioned in between the main reflector and the counter reflector.

Such a luminaire is known from EP-535416. In the known luminaire, which provides indirect lighting, the problem of glare perceived by an observer is counteracted. Research has shown that human beings have a distinct preference for rooms which are uniformly illuminated. In other words, a person may comfortably perform a task in an area at a relatively low luminance level provided there is a minimum of light available and the luminance pattern does not change substantially within his field of view. As indicated, the known luminaire has as a principal aim the generation of light while masking completely the origin of the light. However, a dark area is generated by the counter reflector of the known luminaire due to its shielding function, resulting in a luminance pattern at the ceiling with a substantial change in luminance. The presence of said dark area during operation of the known luminaire is a disadvantage, as it is undesirable from an aesthetic as well as a psychological viewpoint because of the preferences mentioned above.

In another type of luminaire, the counter reflector is provided with a perforation for obtaining a subtle brightness of the counter reflector which reduces the contrast between the relatively dark counter reflector and the relatively bright reflector. In such a luminaire, said perforations are liable to be obstructed of by collection of dust and/or dead insects, thus blocking light transmission through said perforations and subsequent loss of the subtle brightness of the counter reflector.

It is an object of the invention to provide a luminaire of the type described in the opening paragraph in which said disadvantage is counteracted. The luminaire of the type described in the opening paragraph is for this purpose characterized in that the counter reflector is provided with a light-transmitting cover which is positioned at a side of the counter reflector facing away from the means for accommodating the at least one lamp and which cover has a light-entry face exposed to the light-emissions window, and which cover has a light-exit surface at the side facing away from the means for accommodating the at least one lamp. Part of the light generated by the lamp is coupled into the light-transmitting cover, either directly or after being reflected by the main reflector. Said light is partly transmitted via internal reflection through the bulk material of the cover. Light is coupled out of the cover via the scattering of light due to defects present in the bulk, for example inhomogenities or voids, or at the surface, for example scratches, of the cover.

In an alternative embodiment of the inventive luminaire, the counter reflector consists of a reflective coating provided on a side of the cover facing towards the means for accommodating the at least one electric lamp. In such a version the counter reflector is in fact integral with the cover. An additional advantage of this arrangement is the possibility to make use of reflection qualities at the outer cover surface. Reflections on this surface contribute to a desired luminance distribution of the cover.

In an embodiment of the inventive luminaire, the cover is an optical waveguide. The application of an optical waveguide renders possible a controlled distribution of light emission from the optical waveguide. Thus a relatively homogeneous and subtle brightness of the cover has become possible.

In a further embodiment of the inventive luminaire, the cover is connected to the counter reflector via suspension means. To avoid uncontrolled light exitance, the cover may be close to the counter reflector but must not make 'optical' contact i.e. the light-guiding properties of the cover may not be influenced by said contact. Preferably, the cover for this purpose essentially only contacts the counter reflector with its suspension means. It is further preferred that the suspension means consist of an outer edge of the counter reflector for obtaining an even more homogeneous brightness of the cover. The cover is partly coated with a reflective layer. In a special version, the inner surface of the transparent cover could be (partly) coated with a layer, for example a metal layer of aluminum, having 'optical' contact, for example through vacuum deposition. Thus the cover can relatively easily be given a desired, subtle brightness pattern.

In still another embodiment of the inventive luminaire, the cover is provided with a light-outcoupling element. The light extraction may be realized by a structure of lenses, prisms, a diffusor body, and combinations thereof. Locally, the light is prevented from further guidance through the medium into exitance in observers' directions. Such a light-outcoupling element provides a desired distribution and appearance of the optical brightness of the cover.

In an alternative embodiment of the inventive luminaire, the diffusor body is provided at a side of the cover facing away from the counter reflector and are partly recessed in the cover. The brightness of the diffusor body depends on many geometrical parameters and on the opacity of the diffusor material. All these factors can be influenced by the designer and make it possible to bring about a desired brightness effect. The diffusor body has a penetration depth p and an object dimension o. Both p and o determine the fraction of light available for scattering at the diffusor body. The cover has a decreasing thickness n which determines the fraction of light available for guidance towards diffusers further away. The diffusor body is positioned at a distance d from an adjacent diffusor body, which d determines the average luminance over a major portion of the cover. The diffusor bodies may be made of an opaque material which may be co-extruded in the appropriate geometry together with the extrusion of the clear main part.

In another alternative embodiment of the inventive luminaire, an edge of the cover is coated with a color filter. The cover may thus be given a desired color appearance by means of an appropriate color filter.

Other features and advantages of the invention are elucidated in schematic drawings of the luminaire, in which FIG. 1 is a cross-section of a first embodiment of the inventive luminaire;

Figure 1:
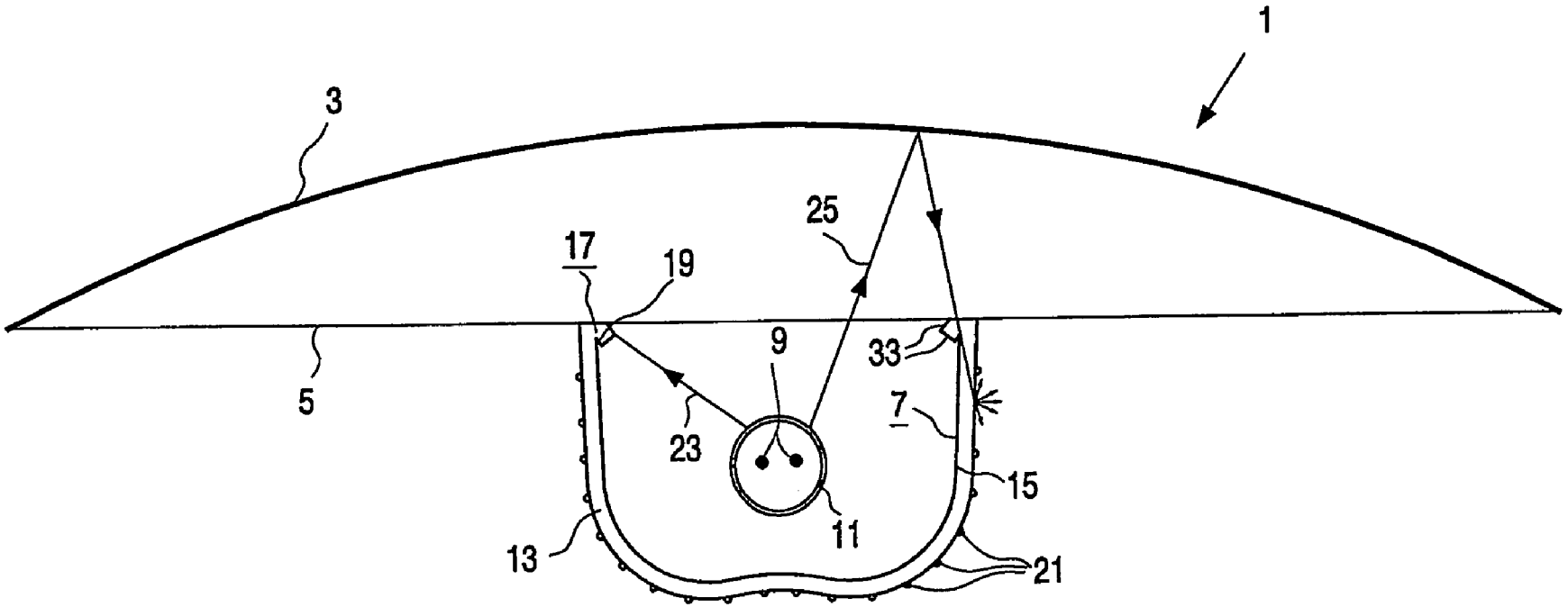

FIG. 1 shows a luminaire 1 comprising a main reflector 3 with a light emission window 5, and comprising a counter reflector 7 positioned opposite the main reflector. Means 9 for accommodating at least one electric lamp 11 are provided in the luminaire in between the main reflector and the counter reflector. The counter reflector is provided with a light-transmitting cover 13, for example made of transparent polycarbonate acting as an optical waveguide and which is positioned at a side 15 of the counter reflector facing away from the means 9. Suspension contacts 17, formed by an outer edge 19 of the counter reflector in the Figure, connect the cover to the counter reflector. As shown in detail in FIG. 2, these suspension contacts form the only contacts between the counter reflector and the cover to counteract undesired exitance of light. The cover is provided with diffusor bodies 21 which scatter the light that is coupled into the cover at a light-entry face 33, either directly, for example via a light ray 23, or indirectly such as via a light ray 25 which is reflected by the main reflector and which is transmitted through the bulk of the cover.

Figure 2:
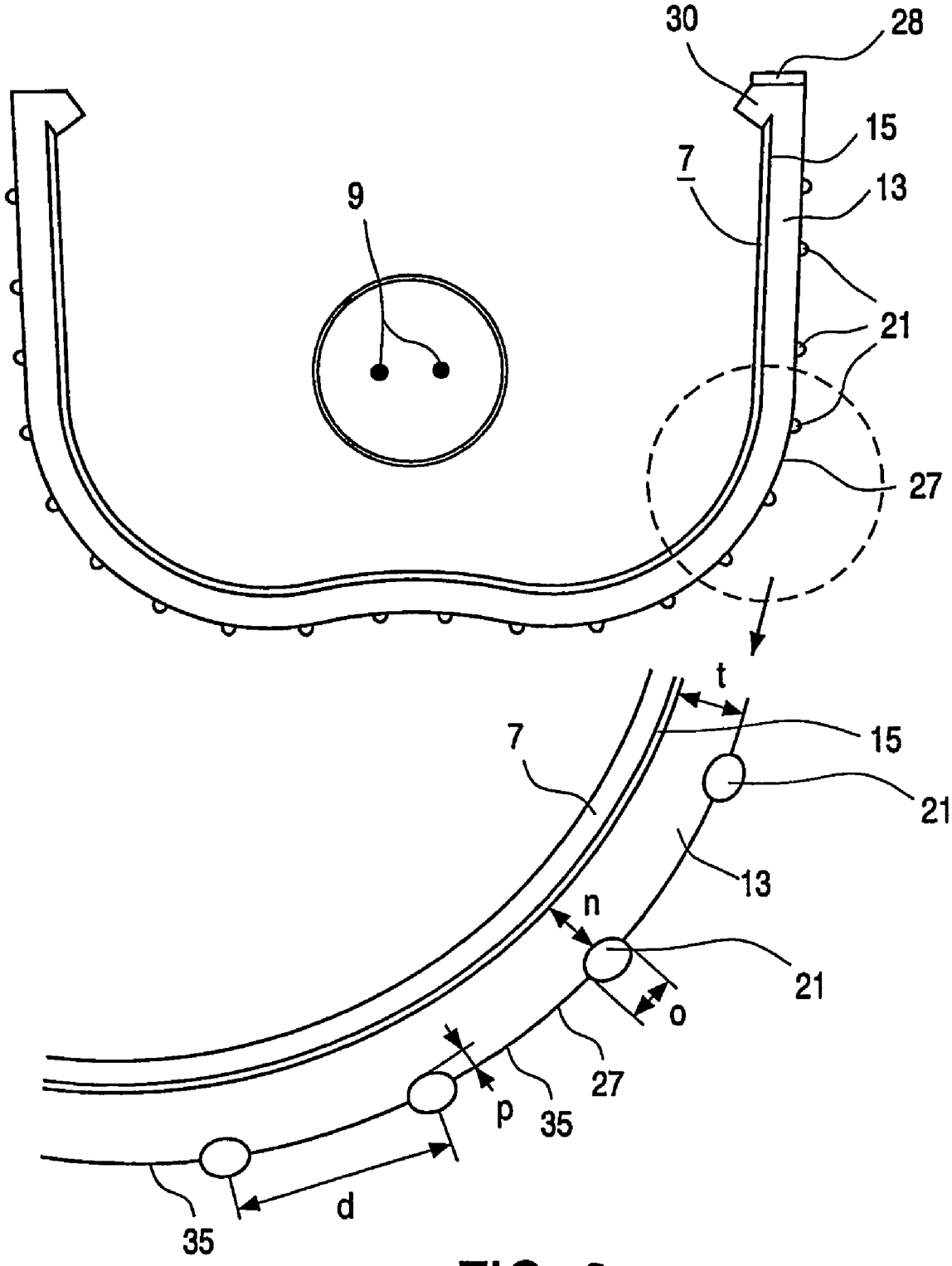
FIG. 2 is a detail of the luminaire of FIG. 1.

FIG. 2 shows that the cover 13 in the inventive luminaire of FIG. 1 is provided on the counter reflector 7 at a side 15 facing away from the means 9. Diffusor bodies 21 are provided at a side 27 of the cover facing away from the counter reflector. Said diffusor bodies are partly recessed in the cover. The diffusor bodies have a penetration depth p and an object diameter o for this purpose. Both p and o determine the fraction of light available for scattering in that location, thus light is coupled out of the light-exit surface 35 of the cover. The cover has a narrowing thickness n which determines the fraction of light available for guidance towards diffusers further away. The diffusor bodies are mutually positioned at a distance d from adjacent diffusor bodies, which d determines the average luminance over a major portion of the cover. The diffusor bodies are made of an opaque material, for example opaque polycarbonate, which may be co-extruded in the appropriate geometry together with the extrusion of the clear main part of the cover. In the Figure, the clear part has a thickness of 2 mm with diffusing 'lines' of o=1.4 mm, p=0.15 mm, and d=6 mm. A satisfactory luminance distribution of the cover in the luminaire is achieved with the given set of dimensions. The penetration depth p may vary from 0 to 20% of a thickness t at an entrance of the cover to 20 to 100% of t in locations farthest removed from the diffusor bodies. A color filter 28 is provided as a coating at an edge 30 of the cover.

Figure 3:
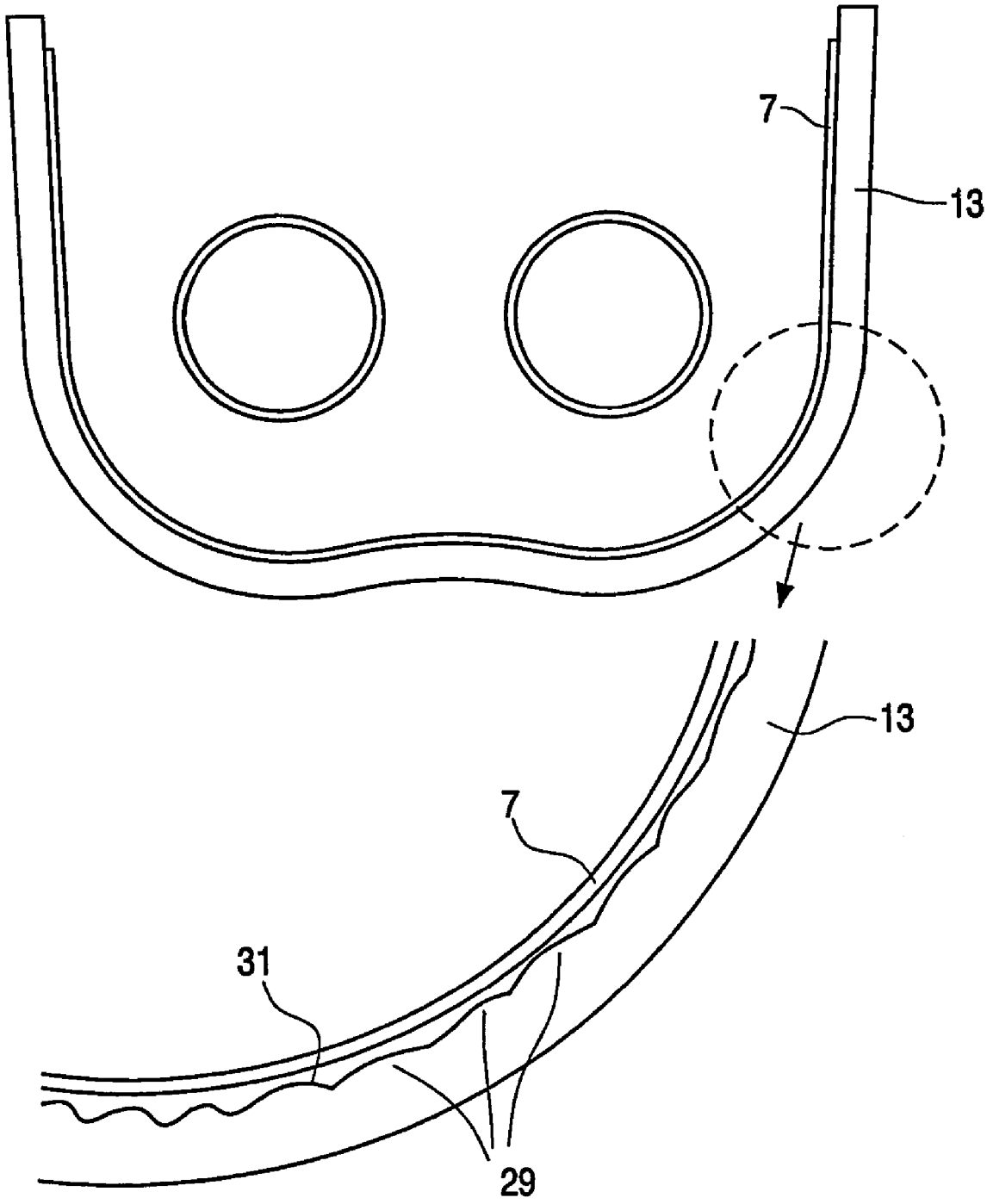
FIG. 3 is a detail of another embodiment of the inventive luminaire.

FIG. 3 is a detail of another embodiment of the inventive luminaire in which it is shown that the cover 13 is provided with a light-outcoupling element, i.e. lenses 29 adjacent to and/or at a surface 31 facing towards the counter reflector 7 in the Figure.

The invention claimed is:

1. A luminaire comprising:

a main reflector with a light emission window;

a counter reflector positioned opposite to the main reflector;

means for accommodating at least one electric lamp positioned in between the main reflector and the counter reflector, characterized in that the counter reflector is provided with suspension means and a light-transmitting cover, wherein the suspension means comprises an outer edge of the counter reflector for connecting the light-transmitting cover to the counter reflector and further wherein the suspension means forms essentially an only contact between the counter reflector and the light-transmitting cover such that the light-transmitting cover is close to the counter reflector but not in optical contact with the counter reflector, and wherein the light-transmitting cover is positioned at a side of the counter reflector facing away from the means for accommodating the at least one lamp, and which the light-transmitting cover has a light-entry face exposed to the light emission window, and which the light-transmitting cover has a light-exit surface at a side of the light-transmitting cover facing away from the means for accommodating the at least one lamp, wherein the light-transmitting cover further includes opaque diffuser bodies that are partly recessed in the light-transmitting cover at the side of the cover facing away from the means for accommodating the at least one lamp.

2. A luminaire as claimed in claim 1, characterized in that the light-transmitting cover is an optical waveguide.

3. A luminaire as claimed in claim 1 characterized in that the light-transmitting cover is partly coated with a reflective layer on a side of the light-transmitting cover facing towards the means for accommodating the at least one lamp.

4. A luminaire as claimed in claim 1, characterized in that the light-transmitting cover is provided with a light-outcoupling element.

5. A luminaire as claimed in claim 4, characterized in that the light-outcoupling element is chosen from the group consisting of a lens, a prism, and combinations thereof.

6. A luminaire as claimed in claim 5, characterized in that the outcoupling element is provided at a side of the light-transmitting cover facing towards the counter reflector.

7. A luminaire as claimed in claim 1, characterized in that an edge of the light-transmitting cover is coated with a color filter.

* * * * *